US008251504B2

(12) United States Patent
Viturro et al.

(10) Patent No.: US 8,251,504 B2
(45) Date of Patent: Aug. 28, 2012

(54) REFLEX PRINTING WITH TEMPERATURE FEEDBACK CONTROL

(75) Inventors: R. Enrique Viturro, Rochester, NY (US); Yongsoon Eun, Webster, NY (US); Todd Thayer, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 315 days.

(21) Appl. No.: 12/761,786

(22) Filed: Apr. 16, 2010

(65) Prior Publication Data

US 2011/0252992 A1 Oct. 20, 2011

(51) Int. Cl.
*B41J 2/01* (2006.01)
*B41J 29/393* (2006.01)

(52) U.S. Cl. ..... 347/101; 347/19

(58) Field of Classification Search ..... None
See application file for complete search history.

(56) References Cited

U.S. PATENT DOCUMENTS 3,694,634 A * 9/1972 Horst et al. ..... 700/68
4,401,024 A 8/1983 Frentress
4,887,530 A 12/1989 Sainio
4,990,767 A 2/1991 Ernst et al.
5,325,159 A 6/1994 Day
5,455,668 A 10/1995 De Bock et al.
5,499,093 A 3/1996 Aerens et al.
5,539,498 A 7/1996 De Cock et al.
5,600,352 A 2/1997 Knierim et al.
5,828,937 A 10/1998 Aerens et al.
5,887,236 A 3/1999 Hirao et al.
6,003,440 A * 12/1999 Koskinen et al. ..... 100/35
6,049,680 A 4/2000 Goris et al.
6,072,587 A 6/2000 Hicks
6,076,922 A 6/2000 Knierim
6,215,119 B1 4/2001 Markham et al.
6,266,437 B1 7/2001 Eichel et al.
6,330,424 B1 12/2001 Chapman et al.
6,407,678 B1 6/2002 Elgee et al.
6,639,669 B2 10/2003 Hubble, III et al.
7,245,862 B2 7/2007 Ebara
7,467,838 B2 12/2008 Folkins et al.
7,583,920 B2 9/2009 Willemsens et al.
7,584,699 B2 9/2009 Ford
7,587,157 B2 9/2009 Matsuda et al.
7,647,018 B2 1/2010 Moore et al.
8,162,428 B2 * 4/2012 Eun et al. ..... 347/16
2002/0131800 A1 9/2002 Jacob et al.
2003/0210932 A1 11/2003 Koide et al.
2006/0072939 A1 4/2006 Kremer et al.
2006/0109329 A1 5/2006 Holtman et al.
2006/0109330 A1 5/2006 Holtman
2006/0114302 A1 6/2006 Holtman
2008/0088661 A1 4/2008 Folkins et al.
2009/0265950 A1 10/2009 Mizes et al.
2009/0293750 A1 12/2009 Haenni et al.

* cited by examiner

*Primary Examiner* — Geoffrey Mruk
(74) *Attorney, Agent, or Firm* — Maginot, Moore & Beck, LLP

(57) ABSTRACT

A method for operating a web printing system enables web and roller changes arising from temperature changes to be identified and used to adjust operation of the reflex registration system. The method includes identifying a temperature change for at least one roller in a web printing system, identifying a temperature change for a web moving through the web printing system at one or more locations in the web printing system, modifying web velocity computations for a reflex registration system with reference to the identified temperature change for the at least one roller and the identified temperature change for the web, and operating printheads to eject ink onto the web at positions identified with reference to the modified web velocity computations.

8 Claims, 3 Drawing Sheets

REFLEX PRINTING WITH TEMPERATURE FEEDBACK CONTROL

TECHNICAL FIELD

This disclosure relates generally to moving web printing systems, and more particularly, to moving web printing systems that use a reflex system to register images printed by different printheads.

BACKGROUND

A known system for ejecting ink to form images on a moving web of media material is shown in FIG. 3. The system 10 includes a web unwinding unit 14, a paper conditioning unit 16, a media preparation station 18, a pre-heater roller 22, a plurality of marking stations 26, a turn roller 30, a leveling roller 34, and a spreader 38. In brief, the web unwinding unit 14 includes an actuator, such as an electrical motor, that rotates a web of media material in a direction that removes media material from the web. The media material is fed from the unwinding unit 14 through the paper conditioning unit 16 and the media preparation station 18 along a path formed by the pre-heater roller 22, turn roller 30, and leveling roller 34 and then through the spreader 38 to a rewinder 40. The paper conditioning unit includes a heated roller that heats the media to a predetermined temperature to begin media surface preparation. The media preparation station 18 removes debris and loose particulate matter from the web surface to be printed and the pre-heater roller 22 is heated to a temperature that transfers sufficient heat to the media material for optimal ink reception on the web surface as it passes the marking stations 26. Each of the marking stations 26A, 26B, 26C, and 26D in FIG. 3 includes two staggered full width printhead arrays, each of which has three or more printheads that eject ink onto the web surface. The different marking stations eject different colored inks onto the web to form a composite colored image. In one system, the marking stations eject cyan, magenta, yellow, and black ink for forming composite colored images. The surface of the web receiving ink does not encounter a roller until it contacts the leveling roller 34. Leveling roller 34 modifies the temperature of the web and reduces any temperature differences between inked and non-inked portions of the web. After the temperature leveling, the ink is heated by non-contact heater 44 before the printed web enters the spreader 38. The spreader 38 applies pressure to the ejected ink on the surface of the web to smooth the roughly semicircular ink drops on the surface of the web and to encourage ink fill with the different colors and present a more uniform image to a viewer. The web material is then wound around the rewinding unit 40 for movement to another system for further processing of the printed web.

This system 10 also includes two load cells, one of which is mounted at a position prior to pre-heater roller 22 and the other is mounted at a position near the turn roller 30. These load cells generate signals corresponding to the tension on the web proximate the position of the load cell. Each of the rollers 22, 30, and 34 has an encoder mounted near the surface of the roller. These encoders may be mechanical or electronic devices that measure the angular velocity of a roller monitored by the encoder, which generates a signal corresponding to the angular velocity of the roller. In a known manner, the signal corresponding to the angular velocity measured by an encoder is provided to the controller 60, which converts the angular velocity to a linear web velocity. The linear web velocity may also be adjusted by the controller 60 with reference to the tension measurement signals generated by the load cells. The controller 60 may be configured with I/O circuitry, memory, programmed instructions, and other electronic components to implement a double reflex printing system that generates the firing signals for the printheads in the marking stations 26. The term "controller" or "processor" as used in this document refers to a combination of electronic circuitry and software that generate electrical signals to control a portion or all of a process or system.

The controller 60 may implement either a single reflex or a double reflex registration system to time the delivery of firing signals to printheads in a print zone of a web printing system. "Double reflex registration system" refers to a system that uses the angular velocity signals corresponding to the rotation of two or more rollers to compute the web velocity at a printhead positioned between the rollers. A single reflex registration system refers to a system that uses the angular velocity signals corresponding to the rotation of only one roller to compute a linear web velocity that is used to predict web positions and timing in a print zone. A double reflex control system is described in U.S. Pat. No. 7,665,817, which is entitled "Double Reflex Printing" and which issued on Feb. 23, 2010 and is owned by the assignee of the present application. The disclosure of this patent is expressly incorporated herein by reference in its entirety.

The system 10 may also include an imaging device 68, such as an image-on-web array (IOWA) sensor, that generates image data corresponding to a portion of the web passing the imaging device. The imaging device 68 may be implemented with a plurality of imaging sensors that are arranged in a single or multiple row array that extends across at least a portion of the web to be printed. The imaging device directs light towards the moving web and the imaging sensors generate electrical signals having an intensity corresponding to the light reflected off the web. The intensity of the reflected light is dependent upon the amount of light absorbed by the ink on the surface, the light scattered by the web structure, and the light reflected by the ink and web surface. The imaging device 68 is communicatively coupled to the machine controller 60 to enable the image data generated by the imaging device 68 to be received and processed by the controller 60. This image data processing enables the controller to detect the presence and position of ink drops ejected onto the surface of the web at the imaging device 68.

As noted above, the controller 60 uses the tension measurements from the two load cells along with the angular velocity measurements from encoders to compute linear web velocities at the rollers 22, 30, and 34. These linear velocities enable the processor to determine when a web portion printed by one marking station, station 26A, for example, is opposite another marking station, stations 26B, for example, so the second marking station can be operated by the controller 60 with firing signals to eject ink of a different color onto the web in proper registration with the ink already placed on the web by a previous marking station. When the subsequent marking station is operated too soon or too late, the ejected ink lands on the web at positions that may produce visual noise in the image. This effect is known as misregistration. Accurate measurements, therefore, are important in registration of different colored images on the web to produce images with little or no visual noise.

Accurate angular velocity measurements simplify the process of determining the linear velocity of the web at a particular position and the timing of the firing signals correlated to the linear web velocity. In previously known image registration systems, a constant diameter is used for each roller that is monitored by an encoder to generate an angular velocity signal, which is used to compute a linear web velocity.

Assuming that the diameter of a roller remains constant may lead to inaccuracies in web velocity calculations. The inaccuracy may be particularly troublesome in heated rollers. These rollers include a heating element that is mounted within the roller or proximate the roller to heat the roller to a temperature above the ambient temperature of the environment of the roller. The heated roller may be used for such purposes as preconditioning the web for printing or the like. When the roller is heated, the material forming the rotating cylinder of the roller expands. This expansion is particularly apparent in rollers having cylinders formed from metal, such as aluminum or stainless steel. The changes in the diameter of the roller cylinder may be significant enough to affect the accuracy of the velocity computed for the web and the timing of the firing signals for the printheads that eject ink as the web passes by the printheads.

Other factors also contribute to the accuracy of the timing of the firing signals. For example, one factor affecting the registration of images printed by different groups of printheads is web shrinkage. Web shrinkage is caused as the web is subjected to relatively high temperatures as the web moves along the relatively long path through the web printing system. The high temperatures drive moisture content from the web, which causes the web to shrink. If the physical dimensions of the web change after one group of printheads has formed an image in one color ink, but before another group of printheads has formed an image in another color of ink, then the registration of the two images is affected. The change may be sufficient to cause misregistration between ink patterns ejected by the different groups of printheads. The amount of shrinkage depends upon the heat to which the web is subjected, the speed of the web as it moves over heated components, the moisture content of the paper, and the type of paper. Additionally, the amount of water in the web alters the elasticity of the web and the computations for web velocities with those changes. Addressing the web changes and roller changes during operation of a web printing system to reduce their impact on image registration is a goal in web printing systems.

SUMMARY

A method for operating a web printing system enables web and roller changes arising from temperature changes to be identified and used to adjust operation of the reflex registration system. The method includes identifying a temperature change for at least one roller in a web printing system, identifying a temperature change for a web moving through the web printing system at one or more locations in the web printing system, modifying web velocity computations for a reflex registration system with reference to the identified temperature change for the at least one roller and the identified temperature change for the web, and operating printheads to eject ink onto the web at positions identified with reference to the modified web velocity computations.

A web printing system enables web and roller changes arising from temperature changes to be identified and used to adjust operation of the reflex registration system. The web printing system includes a roller configured to rotate with a web moving through a web printing system, an encoder mounted proximate the roller to generate a signal corresponding to an angular velocity of the roller, a first temperature sensor mounted proximate the roller to generate a signal corresponding to a temperature of the roller, a second temperature sensor mounted proximate a position by which the web passes as the web moves through the web printing system to generate a signal corresponding to a temperature of the web, and a controller communicatively coupled to the encoder, the first temperature sensor, and the second temperature sensor, the controller being configured to identify a distance change in a diameter of the roller with reference to a temperature signal received from the first temperature sensor, to identify a change in a parameter of the web with reference to a temperature signal received from the second temperature sensor, and to compute a web velocity for the web moving through the web printing system with reference to the distance change in the diameter of the roller and the change in the web parameter, and the controller also being configured to operate a plurality of printheads to eject ink onto the web at positions corresponding to the computed web velocity.

BRIEF DESCRIPTION OF THE FIGURES

The foregoing aspects and other features of a system and method that identify web and roller changes in a web printing system arising from temperature changes and that adjust parameters for computing a web velocity in the web printing system are explained in the following description, taken in connection with the accompanying drawings.

DETAILED DESCRIPTION

Figure 1:
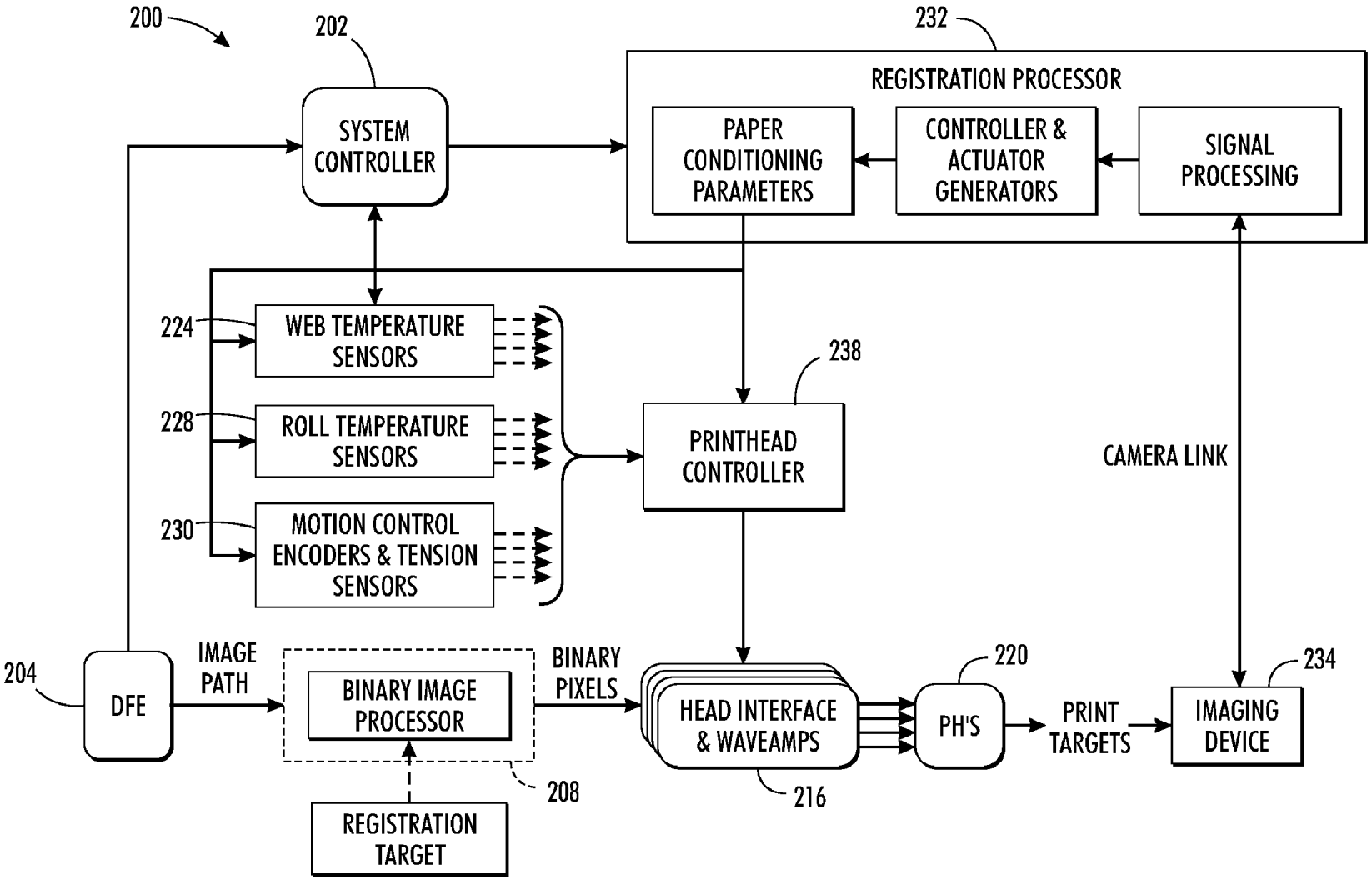
FIG. 1 is a block diagram of a web printing system that identifies web and roller changes arising from temperature changes and that adjusts parameters for computing a web velocity in the web printing system.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system for operating a printer that forms images on a moving web driven by rollers. Also, the word "component" refers to a device or subsystem in the web printing system that is operated by a controller in the web printing system to condition the web, print the web, or move the web through the web printing system.

In one embodiment of a web printing system that uses a double reflex technique to control the firing of the printheads in the marking stations, the marking stations are solid ink marking stations. Solid ink marking stations use ink that is delivered in solid form to the printer, transported to a melting device where the ink is heated to a melting temperature and converted to liquid ink. The liquid ink is supplied to the printheads in the marking stations and ejected from the printheads onto the moving web in response to firing signals generated by the controller 60. In such a continuous feed direct marking system, the print zone is the portion of the web extending from the first marking station to the last marking station. In some systems, this print zone may be several meters long. If the angular velocity of each encoder mounted proximate to a roller is converted to a linear speed for the web, the variations between the linear web velocities at the different rollers over time can accumulate and lead to misregistration of the images.

At steady state for such a printing system, the average web velocity times the web material mass per length must be equal at all rollers or other non-slip web interface surfaces. Otherwise, the web would either break or go slack. To account for the differences in instantaneous velocities at rollers in or near a print zone, a double reflex processor interpolates between linear web velocities at a pair of rollers, one roller on each side of a marking station with reference to the direction of the moving web, to identify a linear velocity for the web at a position proximate the marking station. This interpolation uses the linear web velocity derived from the angular velocity of a roller placed at a position before the web reaches the marking station and the linear web velocity derived from the angular velocity of a roller placed at a position after the web passes by the marking station along with the relative distances between the marking station and the two rollers. The interpolated value correlates to a linear web velocity at the marking station. A linear web velocity is interpolated for each marking station. The interpolated web velocity at each marking station enables the processor to generate the firing signals for the printheads in each marking station to eject ink as the appropriate portion of the web travels past each marking station.

Figure 3:
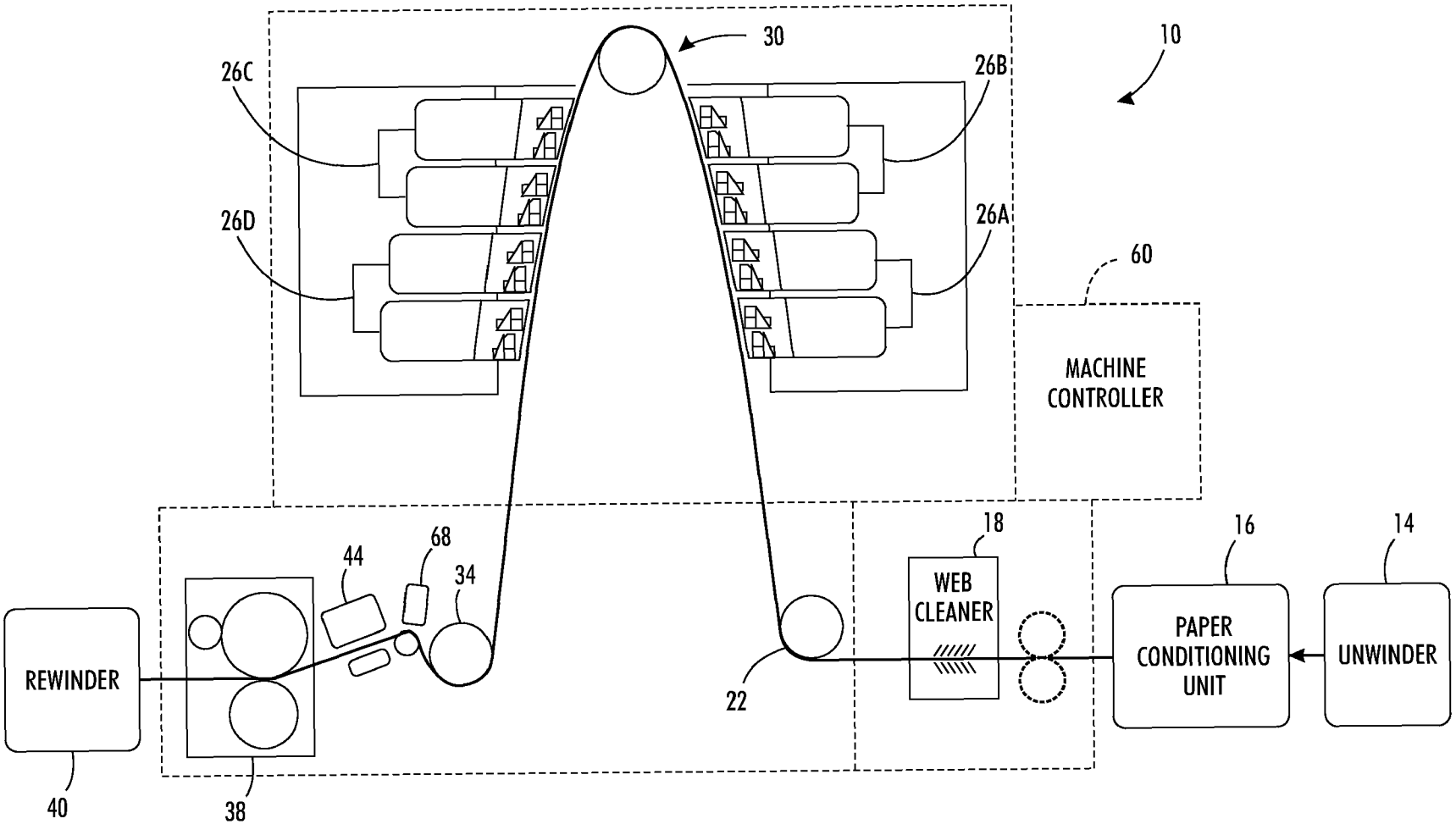
FIG. 3 is a block diagram of a system that calculates web velocity using a double reflex registration process.

In a printing system, such as the one shown in FIG. 3, the rollers over which the web travels as the web moves through the system fluctuate in temperature. Because these rollers are made of materials that have a coefficient of expansion, the temperature fluctuations produce diameter changes in the rollers. The diameter changes, in turn, affect the angular velocities measured by the encoders and the corresponding linear velocity of the web computed with reference to the angular velocities of the rollers. Additionally, the changing temperatures of the rollers and other components in the system affect the web media. Specifically, the heat may be sufficient to drive moisture from the web, which causes the web to shrink in a cross-process direction and process direction as the web advances past the printheads. This shrinkage also affect the cross-sectional area of the web media. These fluctuating temperatures and the dimensional changes caused in the rollers and web media impact the accuracy of the linear velocity measurements computed by a controller implementing a single reflex or double reflex registration process for generation of the printhead firing signals.

To address misregistration that may arise from web changes and roller changes caused by temperature changes, a method and system have been developed that identify temperature changes in rollers and the web at various positions in the web printing system and that adjust parameters used by the reflex registration system to compute the web velocity. The process may be performed in one manner at system setup that enables the expansion coefficients for web media and rollers to be identified. Also, the process may be performed thereafter to monitor temperature readings in the printing system and to adjust roller diameters and web dimensions in response to temperature changes that affect these registration control parameters.

A system 200 that identifies temperature changes in rollers and the web at various positions in the web printing system and that adjusts parameters used by the reflex registration system to compute the web velocity is shown in block diagram form in FIG. 1. As depicted in that figure, the web printing system 200 includes a system controller 202, a digital front end (DFE) 204, a binary image processor 208, the printhead interface and waveform amplifier boards 216, a plurality of printheads 220, web temperature sensors 224, roller temperature sensors 228, encoders and tension sensors 230, a registration controller 232, a web imaging device 234, and a printhead controller 238.

In more detail, the system controller 202 receives control information for operating the web printing system from a digital front end (DFE) 204. During a job, image data to be printed are also provided by the DFE to the web printing system components that operate the printheads to eject ink onto the web and form ink images that correspond to the images provided by the DFE. These components include the binary image processor 208 and the printhead interface and waveform amplifier boards 216. The binary processor performs binary imaging processes, such as process direction norming. Each printhead interface and waveform amplifier board 216 generates the firing signals that operate the inkjet ejectors in the printheads 220 that are electrically coupled to one of the boards 216. Registration and color control are provided by the registration controller 232 adjusting inkjet timing and printhead position. The imaging device 234 provides the registration controller 232 with image data of the web at a predetermined position along the web path through the web printing system. The registration controller performs signal processing on the image data received from the imaging device to determine the positions of the ejected ink on the web. The temperatures of the web at various locations in the web printing system are provided by the web temperature sensors 224, the temperatures of the rollers in the web printing system are provided by the roller temperature sensors 228, and the angular velocities of the rollers and the tension on the web at various locations are provided by the encoders and tension sensors 230. These temperature, velocity, and tension values are provided to the printhead controller 238. These values may be used as described below to compute modified angular velocities for the rollers and web velocities. Additionally, the printhead controller receives position error data from the registration controller 232. These data may be used to adjust parameters for the web velocity computations.

The controllers used in the system 200 include memory storage for data and programmed instructions. The controllers may be implemented with general or specialized programmable processors that execute programmed instructions. The instructions and data required to perform the programmed functions may be stored in memory associated with each controller. The programmed instructions, memories, and interface circuitry configure the controller to perform the functions described above. These controllers may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

As noted above, errors to the angular velocity signals may be introduced by changes in the diameter of a roller caused by thermal expansion of the roller. To address these sources of web speed and position error, a method and system have been developed that uses a coefficient of thermal expansion for a roller to compute a distance change in a diameter of the roller. Thereafter, the coefficient of thermal expansion and a temperature differential that is measured with reference to the baseline temperature at which the coefficient of thermal expansion was measured are used to identify diameter variations in a roller. These diameter variations are used to modify the roller diameter values used to compute web velocity and position error.

Figure 2:
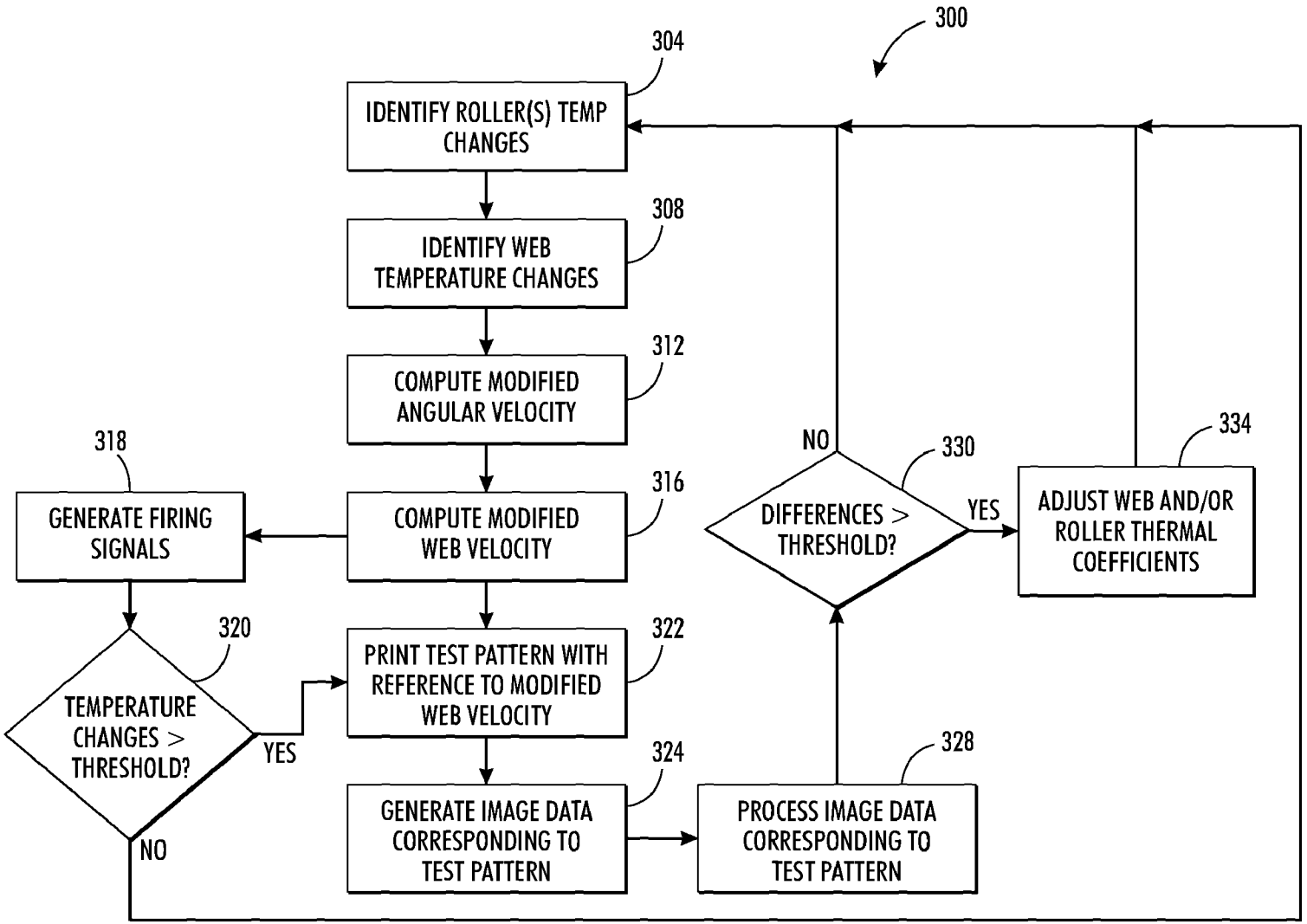
FIG. 2 is a flow diagram of a process that may be implemented by one or more controllers operating in the web printing system of FIG. 1.

In the system 200 shown in FIG. 2, the temperature sensors 224 are mounted in proximity to rollers in the web printing system, which are typically located in the area immediately before, immediately after, and within the area populated with the printheads. These sensors provide temperature signals to the printhead controller 238 that correspond to a temperature of the roller mounted proximate the sensor. Thus, the controller 238 is able to detect the temperature of a roller in the print zone from the signals received from the temperature sensor mounted proximate the roller. In the web velocity measurement process, web velocity may be approximated by the equation: $V_{web}=\omega_{roller}\times(d+th_{paper})/2$, where $V_{web}$ is the web velocity, $\omega_{roller}$ is the angular velocity of a roller obtained from a rotary encoder, d is the diameter of the roller, and $th_{paper}$ is the effective thickness of the web. In a controller that uses a single reflex registration process to compute web velocity and position for the timing of printhead firing, the diameter of only one roller is used for the computation. If the diameter of the roller is treated as a constant, errors are introduced in the web velocity and position calculations as the actual diameter of the roller or rollers used in the registration process changes in response to a temperature change in the roller. In order to address the diameter changes introduced by temperature variations, a coefficient of thermal expansion is identified for each roller. Additionally, the thickness or cross-sectional area of the web affects the web velocity calculation and this web parameter may change with a change in web temperature. Also, the elasticity modulus for the web affects the tension values received from the tension sensors. In order to address these web parameter changes introduced by temperature variations, a coefficient of thermal expansion is identified for the elasticity modulus and cross-sectional area of the web.

The system and method disclosed in this document enables the web imaging device to provide image data to the registration controller 232 for generation of coefficient correction data that are supplied to the printhead controller 238. These coefficient correction data and the temperature data provided by the temperature sensors enable the printhead controller to correct for temperature induced web velocity measurement errors that arise from changes in web parameters and roller diameters. Specifically, the diameter of each roller used to generate the web velocity is described as a sum of an initial diameter and a temperature correction term. Likewise, the elasticity modulus and cross-sectional area of the web are also described as a sum of an initial value and a temperature correction term. The temperature correction terms are given by a thermal expansion coefficient multiplied by a difference in temperature readings. The thermal expansion coefficient may be updated occasionally with reference to the coefficient correction data provided by the registration controller 232. Additionally, the runtime temperature variation of the web may be estimated with reference to a measured temperature variation in the roller and, vice versa the runtime temperature variation of the roller may be estimated with reference to a measured temperature variation in the web. Estimates of temperature variations for either a roller or web may use a relationship between web and roller temperatures based on empirical and/or theoretical physical relationships. For example, an estimated web temperature may be based on roller temperature, web speed, web thickness, and wrap angle. Temperature measurements for each roller and the media, however, would be more precise. As used in this document, identification of a temperature or temperature difference includes estimating the temperature or temperature difference as well as measuring the temperature or temperature difference. Measuring a temperature or temperature difference means using a sensor to quantify a temperature, while estimating means using an empirically observed relationship, a theoretical relationship, or a combination of an empirically observed relationship and theoretical relationship with reference to another temperature or temperature difference to arrive at a temperature or temperature variation without directly measuring the temperature or temperature variation.

Each roller used in the reflex registration process as well as the cross-sectional area and elasticity modulus of the web may be described by the following equations:

$$D=D_0+C_1\cdot\Delta T_1$$

$$E=E_0+C_2\cdot\Delta T_2$$

$$A=A_0+C_3\cdot\Delta T_2$$

In these equations D is the current diameter of a roller used in the web velocity computation, $D_0$ is the initial value of the roller diameter, $C_1$ is the thermal expansion coefficient for the roller, E is the web elasticity modulus, A is the web cross-sectional area, $E_0$ and $A_0$ are the corresponding initial values for the elasticity modulus and cross-sectional area, respectively, and $\Delta T_1$ is the difference between the temperature corresponding to the initial roller diameter and the temperature currently sensed at the roller, and $\Delta T_2$ is the difference between the temperature for the web at the initial elasticity modulus and the initial cross-sectional area and the temperature currently sensed from the web at a location in the web printing system. Thermal coefficients $C_1$, $C_2$, and $C_3$ are predetermined empirically in a known manner. These coefficients may be adjusted as described below by processing image data of the web received from the web imaging device. If more than one roller is used in the web velocity measurements, an equation of the form for the diameter calculation applies to each roller.

The process for identifying an adjustment for the coefficient of thermal expansion for a roller is shown in FIG. 2. The process begins with a temperature difference for one or more rollers being identified (block 304). A temperature difference for the web may also be identified (block 308), although the web temperature difference may be inferred from the roller temperature variation. Similarly, the web temperature difference may be identified and then the roller temperature variation inferred. The process in FIG. 2 is more precise in that temperature readings for the web and the rollers are measured and used. A modified angular velocity for the roller is computed using the current coefficient of thermal expansion, initial roller diameter, and the identified temperature change (block 312). The web linear velocity is then computed using the current coefficient of thermal expansion for the elasticity modulus and cross-sectional area of the web, the initial values for these web parameters, the identified web temperature difference, and the modified angular velocity (block 316). The computed web linear velocity may then be used by the printhead controller to generate firing signals for the printheads (block 318). By compensating for the roller and web changes in the computation of the linear web velocity, the process of FIG. 2 enables the printhead firing signals to be generated more accurately.

Periodically or in response to a detected temperature difference being greater than a predetermined threshold (block 320), the temperature coefficients for the web and/or roller equations may be re-evaluated. To perform the evaluation, a predetermined test pattern may be printed on the web at a position that corresponds to the computed web velocity (block 322). Typically, this position is in an inter-document zone, which is between image areas on the web. The predetermined pattern may be a series of ejected ink drops by each ink jet in a printhead to generate a series of vertical lines. The predetermined pattern on the web is imaged and the image data provided to the registration controller 234 (block 324). The image data are processed to identify a difference between the position identified with reference to the computed web velocity and the position of the pattern in the generated image data (block 328). This difference is then used to adjust the current coefficient of thermal expansion for the roller (block 334), if the identified temperature difference for the roller exceeds a predetermined threshold (block 330), or the current coefficients of thermal expansion for the elasticity modulus and the cross-sectional area of the web are adjusted (block 334), if the identified temperature difference for the web exceeds a predetermined amount (block 330).

The coefficient of thermal expansion for the roller may be identified with reference to the equation: $d=d_0(c(T-T_0)+1)$, where $d_0$ is the diameter of the roller at temperature $T_0$, $T_0$ is the first temperature, T is the second temperature, d is the increased diameter, and c is the coefficient of thermal expansion. This equation may be rewritten to the form: $c=d-d_0/(d_0(T-T_0))$. With reference to the process described above, $d-d_0$ corresponds to the displacement in the predetermined pattern, $d_0$ is the baseline diameter, and $(T-T_0)$ is the difference between the two temperatures. The coefficient of thermal expansion for the elasticity modulus and the cross-sectional area may be computed in a similar manner. Once the coefficient of thermal expansion is adjusted, a predetermined pattern is printed in response to a temperature change of a predetermined amount for the web or the roller. If the position of the predetermined pattern differs from the computed position by at least a predetermined amount, the coefficient of thermal expansion for the roller or the modulus and cross-sectional area are adjusted accordingly. Configuring the controllers of the web printing system to adjust the coefficients of thermal expansion for the rollers, web elasticity modulus, and web cross-sectional area enables the system to compensate for roller and web parameter changes arising from temperature changes in the web printing system.

In operation, the printhead controller obtains signals from temperature sensors mounted proximate the rollers and the web as well as angular velocity signals from rotary encoders mounted proximate the rollers. Adjustments are made to the diameters of the rollers in the print zone with reference to the baseline diameter for each roller, the coefficient of thermal expansion for each roller, and the temperature differential between the current temperature of each roller and its baseline temperature. Similar adjustments are made for the elasticity modulus for the web and the cross-sectional area of the web. The modified roller diameters and web parameters are used in the computations for determining web linear velocity. This velocity computation is then used to generate the printhead firing signals to eject ink onto the web at predicted positions within the print zone. Image data for printed test patterns may be generated and analyzed to identify positional errors arising from temperature changes at the rollers or the web. These positional errors may then be used to modify the coefficient of thermal expansion for the rollers or the coefficients of thermal expansion for the elasticity modulus and cross-sectional area of the web. The adjusted coefficients of thermal expansion enable more accurate computations of the web velocity at the new temperature.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A web printing system comprising:

a roller configured to rotate with a web moving through a web printing system;

an encoder mounted proximate the roller to generate a signal corresponding to an angular velocity of the roller;

a first temperature sensor mounted proximate the roller to generate a signal corresponding to a temperature of the roller;

a second temperature sensor mounted proximate a position by which the web passes as the web moves through the web printing system to generate a signal corresponding to a temperature of the web; and a controller communicatively coupled to the encoder, the first temperature sensor, and the second temperature sensor, the controller being configured to identify a distance change in a diameter of the roller with reference to a temperature signal received from the first temperature sensor, to identify a change in a parameter of the web with reference to a temperature signal received from the second temperature sensor, and to compute a web velocity for the web moving through the web printing system with reference to the distance change in the diameter of the roller and the change in the web parameter, and the controller also being configured to operate a plurality of printheads to eject ink onto the web at positions corresponding to the computed web velocity.

2. The system of claim 1, the controller being further configured to identify a change in an elasticity modulus for the web with reference to the temperature signal received from the second temperature sensor.

3. The system of claim 2, the controller being further configured to identify a cross-sectional area change for the web with reference to the temperature signal received from the second temperature sensor.

4. The system of claim 3, the controller being further configured to identify the change in the elasticity modulus with reference to a product of a first predetermined coefficient and the temperature signal received from the second temperature sensor and to identify the change in the cross-sectional area with reference to a product of a second predetermined coefficient and the temperature signal received from the second temperature sensor.

5. The system of claim 4 further comprising:

an image generating device configured to generate image data of the ejected ink on the web; and the controller being further configured to identify a difference between the positions identified with reference to the computed web velocity and the positions of the ejected ink in the generated image data, and to adjust one of the first and the second predetermined coefficients with reference to the identified difference.

6. The system of claim 5, the controller being further configured to identify the distance change in the diameter of the roller with reference to a product of a third predetermined coefficient and the temperature signal received from the first temperature sensor, and to adjust the third coefficient with reference to the identified position difference.

7. The system of claim 1, the controller being further configured to identify the distance change in the diameter of the roller with reference to a product of a first predetermined coefficient and the temperature signal received from the first temperature sensor.

8. The system of claim 7 further comprising:

an image generating device configured to generate image data corresponding to positions of the ejected ink on the web; and the controller being further configured to identify a difference between the positions corresponding to the computed web velocity and the positions of the ejected ink in the generated image data, and to adjust the first predetermined coefficient with reference to the identified position difference.

* * * * *